US012296925B2

(12) United States Patent
Oswell

(10) Patent No.: US 12,296,925 B2
(45) Date of Patent: May 13, 2025

(54) WIND DEFLECTION APPARATUS, A CONSOLE COMPRISING THE WIND DEFLECTION APPARATUS, AND A BOAT COMPRISING THE WIND DEFLECTION APPARATUS

(71) Applicant: ROSWELL CANADA INC., Acheson (CA)

(72) Inventor: Robert Oswell, Merritt Island, FL (US)

(73) Assignee: ROSWELL CANADA INC., Acheson (CA)

( * ) Notice: Subject to any disclaimer, the term of this patent is extended or adjusted under 35 U.S.C. 154(b) by 682 days.

(21) Appl. No.: 17/575,187

(22) Filed: Jan. 13, 2022

(65) Prior Publication Data

US 2022/0219789 A1 Jul. 14, 2022

Related U.S. Application Data

(60) Provisional application No. 63/137,312, filed on Jan. 14, 2021.

(51) Int. Cl.

| | |
|---|---|
| ***B63B 17/02*** | (2006.01) |
| ***B63B 17/00*** | (2006.01) |
| ***B63B 19/02*** | (2006.01) |

(52) U.S. Cl.

CPC ..... *B63B 17/02* (2013.01); *B63B 19/02* (2013.01); *B63B 2017/0045* (2013.01)

(58) Field of Classification Search

CPC . B63B 17/02; B63B 2017/0045; B63B 19/02; B60H 1/267; B60J 1/14; B60J 1/20; B60J 7/22; B62D 35/00

USPC ..... 114/343; 454/128

See application file for complete search history.

(56) References Cited

U.S. PATENT DOCUMENTS 5,259,582 A * 11/1993 DeLange, III ..... B60R 1/02 248/481
11,708,129 B2 * 7/2023 Oswell ..... B63B 15/00 114/253
2022/0161884 A1 * 5/2022 Kramer ..... B62J 17/00

FOREIGN PATENT DOCUMENTS

CA 2279804 A1 * 2/2001 ..... B63B 17/02

* cited by examiner

*Primary Examiner* — Daniel V Venne
(74) *Attorney, Agent, or Firm* — Timothy H. Van Dyke; Wolter Van Dyke Davis, PLLC

(57) ABSTRACT

An wind deflection apparatus (240), including: a fairing (242, 250) shaped to have a leading edge profile (606) that is configured to cooperate with a side profile of a console (206) to redirect an oncoming airflow laterally away from an occupant positioned behind the console; and a mounting apparatus (350) configured to secure the fairing relative to the console. A console (206) having the wind deflection apparatus. And a boat (202) having the wind deflection apparatus.

15 Claims, 9 Drawing Sheets

WIND DEFLECTION APPARATUS, A CONSOLE COMPRISING THE WIND DEFLECTION APPARATUS, AND A BOAT COMPRISING THE WIND DEFLECTION APPARATUS

FIELD OF THE INVENTION

The invention relates to a wind deflection apparatus for a helm disposed in an open environment.

BACKGROUND OF THE INVENTION

Towers and T-Tops have long been used on boats (e.g. center console boats) as a useful part of the boat that can hold navigation equipment, outriggers, and/or a top (e.g. hard top or soft top) that can provide storage and/or provide shade. In a center console boat, the driver controlling the boat is typically positioned behind the center console at the helm, which typically includes the steering wheel and throttle controls. One or more passengers may also be located astride the driver and/or farther behind the center console.

When the boat is underway, oncoming wind in this open-air environment wraps around the center console and reaches the captain and passengers located behind the center console, forming vortices. The aerodynamic effect becomes more noticeable as speed increases. Approximately twenty miles per hour represents a common threshold speed at which the wind impact and noise can become a nuisance. Current center console boats cruise at speeds greater than this. For example, current boats have cruise speed starting in the twenty to thirty miles per hour range, while others can reach upwards of eighty miles per hour or more. Moreover, it is larger boats that reach the higher speeds, and increasing size (e.g. increased width) also increases the aerodynamic effect, thereby compounding the nuisance. Accordingly, there is room in the art for improvement.

BRIEF DESCRIPTION OF THE DRAWINGS

The invention is explained in the following description in view of the drawings that show.

DETAILED DESCRIPTION OF THE INVENTION

The inventor has devised a new and innovative wind deflection system designed to reduce the amount of wind a driver and passengers encounter when traveling in a boat with an open environment.

Figure 1:
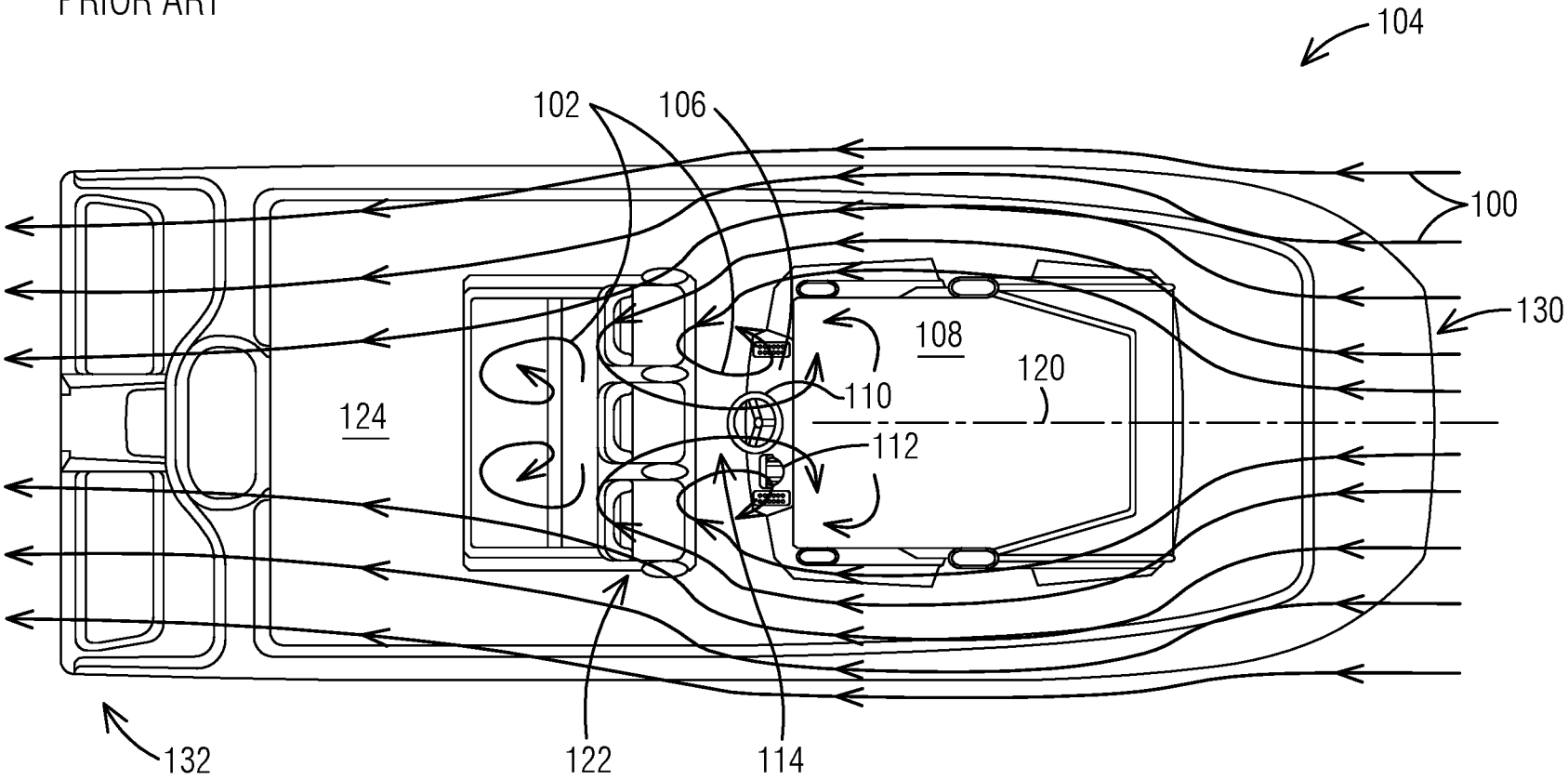
FIG. 1 PRIOR ART
FIG. 1 shows streamlines of an oncoming airflow over a prior art boat having a marine helm in a center console.

FIG. 1 shows streamlines 100 and vortices 102 formed by an oncoming airflow over a prior art boat 104 having a marine helm 106 in a center console 108. The helm 106 typically includes a steering wheel 110 and throttle controls 112. A driver is typically seated or standing at a driver's area 114 behind the center console 108. One or more passengers may be located astride the driver relative to a bow-to-stern axis 120 of the center console 108, on additional seating 122, and/or in an open area 124 behind the center console 108.

As can be seen by the streamlines 100, the oncoming airflow flows over the bow 130 of the boat 104 and is diverted laterally (up and down on the page) with respect to the bow-to-stern axis 120 around the center console 108 as well as up (out of the page) and over the center console 108 to accommodate the center console 108 while enroute to the stern 132. Once past the center console 108, the streamlines 100 quickly converge laterally back together and can even wrap around the center console 108 to form the vortices 102. This convergence happens relatively quickly and essentially directs the converging air onto the driver and any passengers located downstream of the center console 108.

Figure 2:
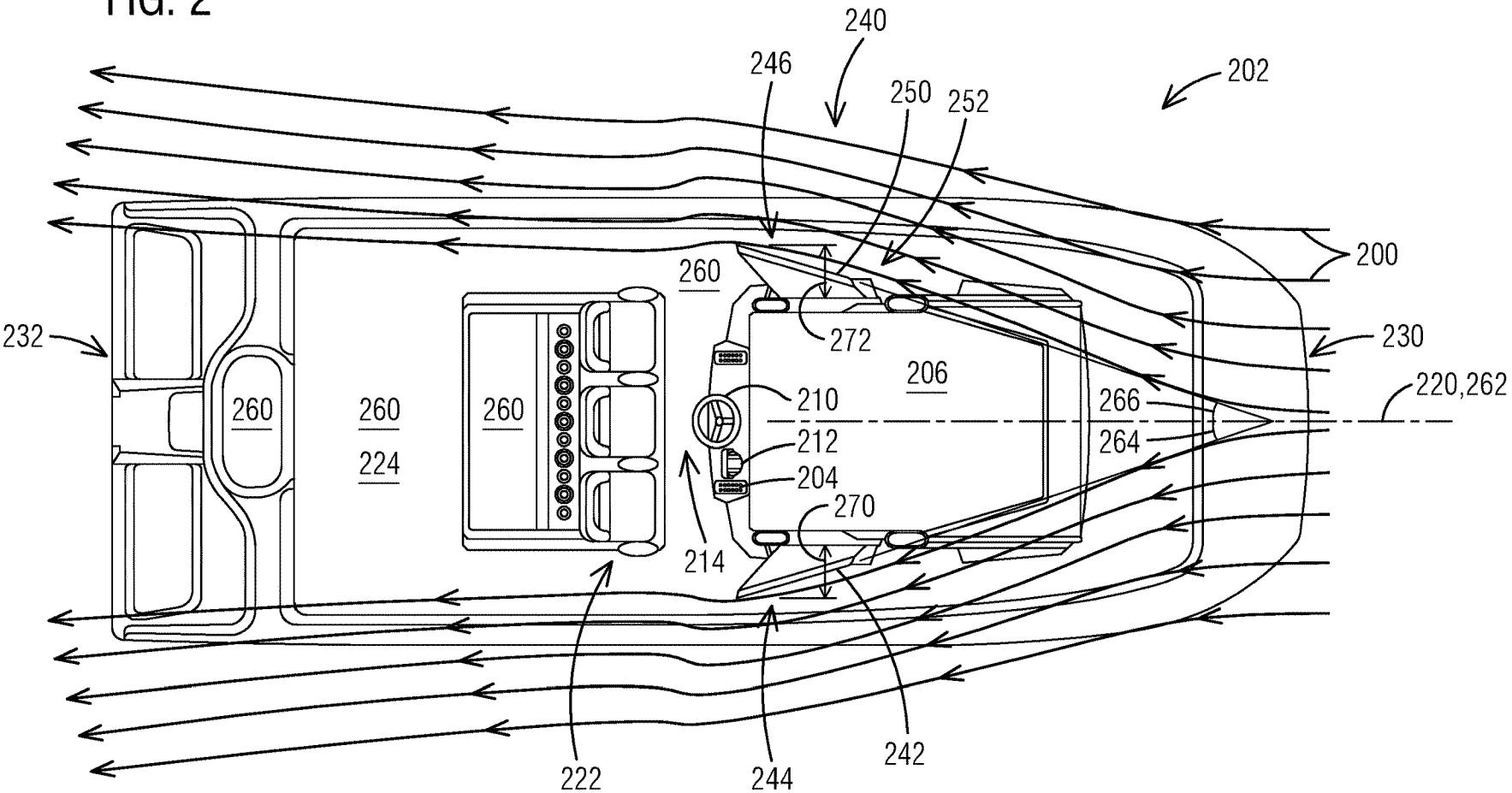
FIG. 2 shows streamlines of an oncoming airflow over a boat having a marine helm in a center console equipped with a wind deflection apparatus as disclosed herein.

FIG. 2 shows streamlines 200 of an oncoming airflow over a boat 202 having a marine helm 204 in a center console 206. Similar to the prior art, the helm 204 includes a steering wheel 210 and throttle controls 212. Likewise, the driver is typically seated or standing at a driver's area 214 behind the center console 206. The one or more passengers may be located astride the driver relative to a bow-to-stern axis 220 of the center console 206, on additional seating 222, and/or in an open area 224 behind the center console 206.

As can be seen by the streamlines 200, the oncoming air similarly flows over the bow 230 of the boat 202 and is similarly diverted laterally (up and down on the page) with respect to the bow-to-stern axis 220 around the center console 206 as well as up (out of the page) and over the center console 206 to accommodate the center console 206 while enroute to the stern 232. However, this center console 206 is equipped with a wind deflection apparatus 240 that, in this example embodiment, includes a starboard fairing 242 secured to a starboard side 244 of the center console 206. In an example embodiment, the starboard fairing 242 is secured proximate a downstream end 246 of the center console 206. The wind deflection apparatus 240 also includes a port fairing 250 secured to a port side 252 of the center console 206. In an example embodiment, the port fairing 250 is secured proximate a downstream end 246 of the center console 206. As used herein, proximate means aft/downstream of a middle of the center console 206. Also as used herein, the bow 230 is considered upstream and the stern 232 is considered downstream. The overall design of the wind deflection apparatus 240 is configured to withstand oncoming airflows encountered at speeds in excess of 100 miles per hour.

The fairings 242, 250 alter the airflow by laterally deflecting the oncoming airflow so that the streamlines converge slower than they converge without the fairings 242, 250. The slower convergence results in the streamlines converging at a location that is farther downstream of the center console 206 than occurs in the prior art. This creates a relatively placid slipstream 260 downstream of the center console 206 that encompasses at least the driver's area 214 behind the center console 206, and at least some of the additional seating 222, and/or an open area 224.

The fairings 242, 250 accomplish this by forming an angle relative to the bow-to-stern axis 220 of the center console 206, which may coincide with a longitudinal axis 262 of the boat 202. The starboard fairing 242 forms a starboard fairing angle 264 with the bow-to-stern axis 220 and optionally with the longitudinal axis 262 of the boat 202. Similarly, the port fairing 250 forms a port fairing angle 266 with the bow-to-stern axis 220 and optionally with the longitudinal axis 262 of the boat 202. In an example embodiment, the starboard fairing angle 264 and the port fairing angle 266 can be any angle from twenty (20) to fifty (50) degrees. In an example embodiment, the starboard fairing angle 264 and the port fairing angle 266 are thirty-five (35) degrees.

The fairings 242, 250 have a perceived width that is a distance the fairing 242, 250 occupies laterally (up and down in FIG. 2) relative to the bow-to-stern axis 220 at any given height (in and out of the page in FIG. 2). The starboard fairing 242 extends a starboard fairing perceived width 270. The port faring 250 extends a port fairing perceived width 272. The perceived width represents a distance the oncoming air approaching the fairing would need to move laterally after encountering a leading edge of the fairing and while traveling to a trailing edge. In other words, it represents a magnitude of deflection of the air from an original path that is necessary to pass by the fairing. It is also a perceived width occupied by the fairing as viewed from in front of the fairing. In an example embodiment, the starboard fairing perceived width 270 and the port fairing perceived width 272 can be any width from five (5) to fifteen (15) inches. In an example embodiment, the starboard fairing perceived width 270 and the port fairing perceived width 272 are nine (9) inches.

In an example embodiment, the starboard fairing 242 and the port fairing 250 are mirror images of each other. However, each may have its own shape necessary to accommodate a shape of the respective side of the center console 206 to which it is secured. Similarly, in an example embodiment, the starboard fairing angle 264 and the port fairing angle 266 may be the same or may be different. Likewise, the starboard fairing perceived width 270 and the port fairing perceived width 272 may be the same or may be different. Moreover, the fairing angle 264, 266 and/or the perceived width 270, 272 may be different for different locations along a height of the fairings 242, 250.

Figure 3:
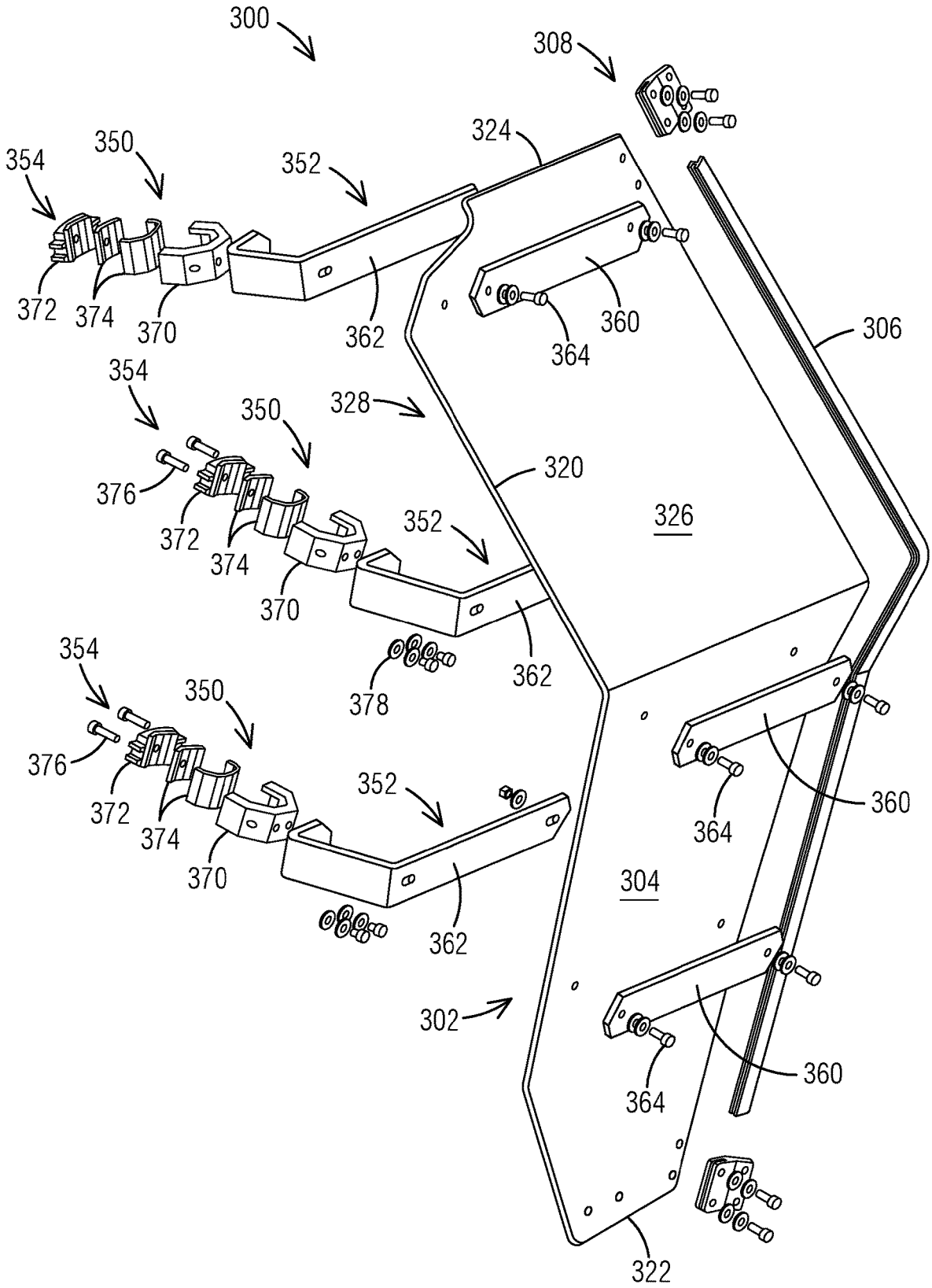
FIG. 3 is an exploded perspective view of an example embodiment of a fixed starboard side wind deflection apparatus.

FIG. 3 is an exploded perspective view of an example embodiment of a fixed starboard side wind deflection apparatus 300. The fixed starboard side wind deflection apparatus 300 includes fairing 302 that includes a panel 304 and optionally includes a leading edge cushion 306 at a leading edge 308 of the fairing 302. The fairing 302 includes the leading edge 308, a trailing edge 320, a bottom edge 322, a top edge 324, a front side 326, and a back side 328. The leading edge 308 is shaped to cooperate with a shape of that to which the fairing 302 will be secured, such as the center console 206. This shape is retained regardless of whether the fairing 302 is secured to the center console 206 or not. As used herein, cooperate includes matching a shape of the location of the center console 206 where there fairing 302 is secured to the center console 206. The leading edge 308 is secured to the center console 206 via brackets at the top and bottom of the leading edge 308 as shown. Alternately, or in addition, the brackets can be disposed at the top edge 324 and anywhere else around the perimeter of the fairing 302. The top left corner (as shown in FIG. 3, may be contoured as shown, or the top corner may be a straight line connecting the trailing edge 320 with the top edge 324. Any portion of the fairing 302 may be contoured to match a shape of any abutting surface.

In an example embodiment, the material has a tensile strength of at least 8,000 psi (55.2 MPa) and a modulus of elasticity of at least 300,000 psi (2,100 MPa) as determined by ASTM Method D638. In an example embodiment, the panel 304 is composed of a transparent material. In an example embodiment, the material is acrylic, plastic, glass, or the like. An example acrylic material has a tensile strength of 10,000 psi (69 MPa) and a modulus of elasticity of 400,000 psi (2,800 MPa). In an example embodiment, the material is not transparent and may be, for example, aluminum, carbon fiber, or fiberglass.

In an example embodiment, the leading edge cushion 306 is composed of PVC, for example, clear PVC or the like. In an example embodiment, the top edge 324 may also be composed of a cushioning material.

In an example embodiment, a chord length between the leading edge 308 and the trailing edge 320 of the fairing 302 ranges from not less than ten (10) inches to not more than twenty (20) inches for any given location between the bottom edge 322 and the top edge 324. In an example embodiment, the chord length is fifteen (15) inches (plus or minus one (1) inch) between the tapers at the top edge 324 and the bottom edge 322. In an example embodiment, an overall height from the top edge 324 to the bottom edge 322 is sixty five (65) inches (plus or minus one (1) inch), an overall length is thirty (30) inches (plus or minus one (1) inch), and an overall width is twelve (12) inches (plus or minus one (1) inch).

Also included is a mounting apparatus 350 configured to secure the fairing 302 to the center console 206. In an example embodiment, the mounting apparatus 350 includes one or more braces 352 that secure the panel 304 to a bracket 354. The bracket, in turn, secures to the center console 206. In an example embodiment, each brace 352 includes a front piece 360 and a rear piece 362 that sandwich the panel 304 via fasteners 364. In an example embodiment, the rear piece 362 includes a J-shape or the like. The dimensions and shapes of the components of each brace 352 may be the same or different within the mounting apparatus 350. In an example embodiment, the front piece 360 and the rear piece 362 may be composed of aluminum, stainless steel, or the like.

In an example embodiment, the bracket 354 comprises a post clamp configured to clamp around a post of the center console 206. In an example embodiment, the post clamp form fits to the post of the center console 206. In an example embodiment, the post clamp includes a first clamp piece 370, a second clamp piece 372, and clamp pads 374, all held together via fasteners 376. The brace 352 is secured to the bracket 354 via fasteners 378. In an example embodiment, the first clamp piece 370 and the second clamp piece 372 may be composed of aluminum, for example 6061 aluminum, stainless steel, or the like. In an example embodiment, the clamp pads 374 may be composed of a plastic, for example, nylon 6/10.

Figure 4:
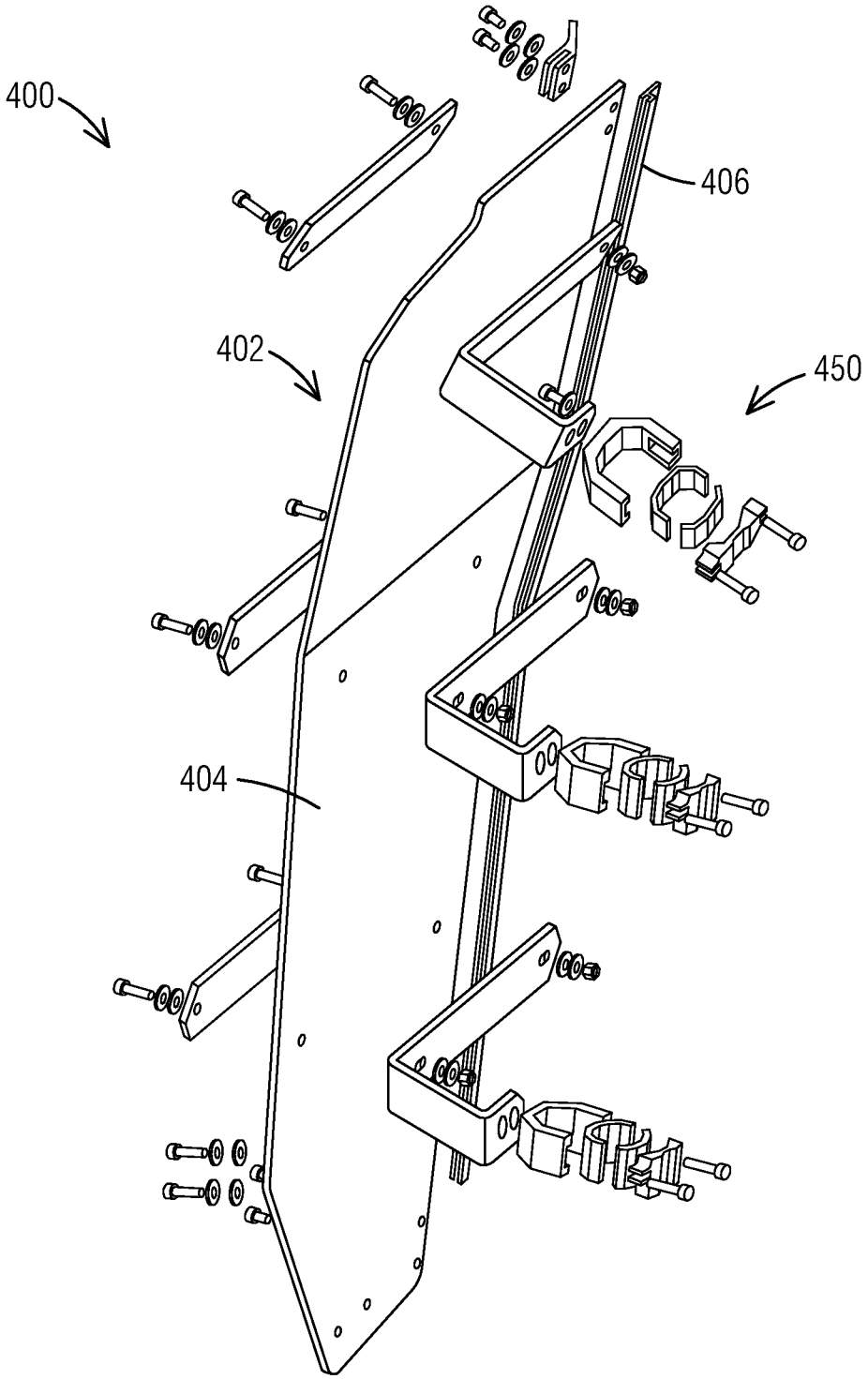
FIG. 4 is an exploded perspective view of an example embodiment of a fixed port side wind deflection apparatus.

FIG. 4 is an exploded perspective view of an example embodiment of a fixed port side wind deflection apparatus 400. In this example embodiment, the fixed port side wind deflection apparatus 400 is a mirror image of the fixed starboard side wind deflection apparatus 300. As such, the fairing 402 is a mirror image of fairing 302, panel 404 is a mirror image of panel 304, and optional leading edge cushion 406 is a mirror image of leading edge cushion 306.

In an example embodiment, the elements of the mounting apparatus 450 are the same as of mounting apparatus 350, though they need not be.

Figure 5:
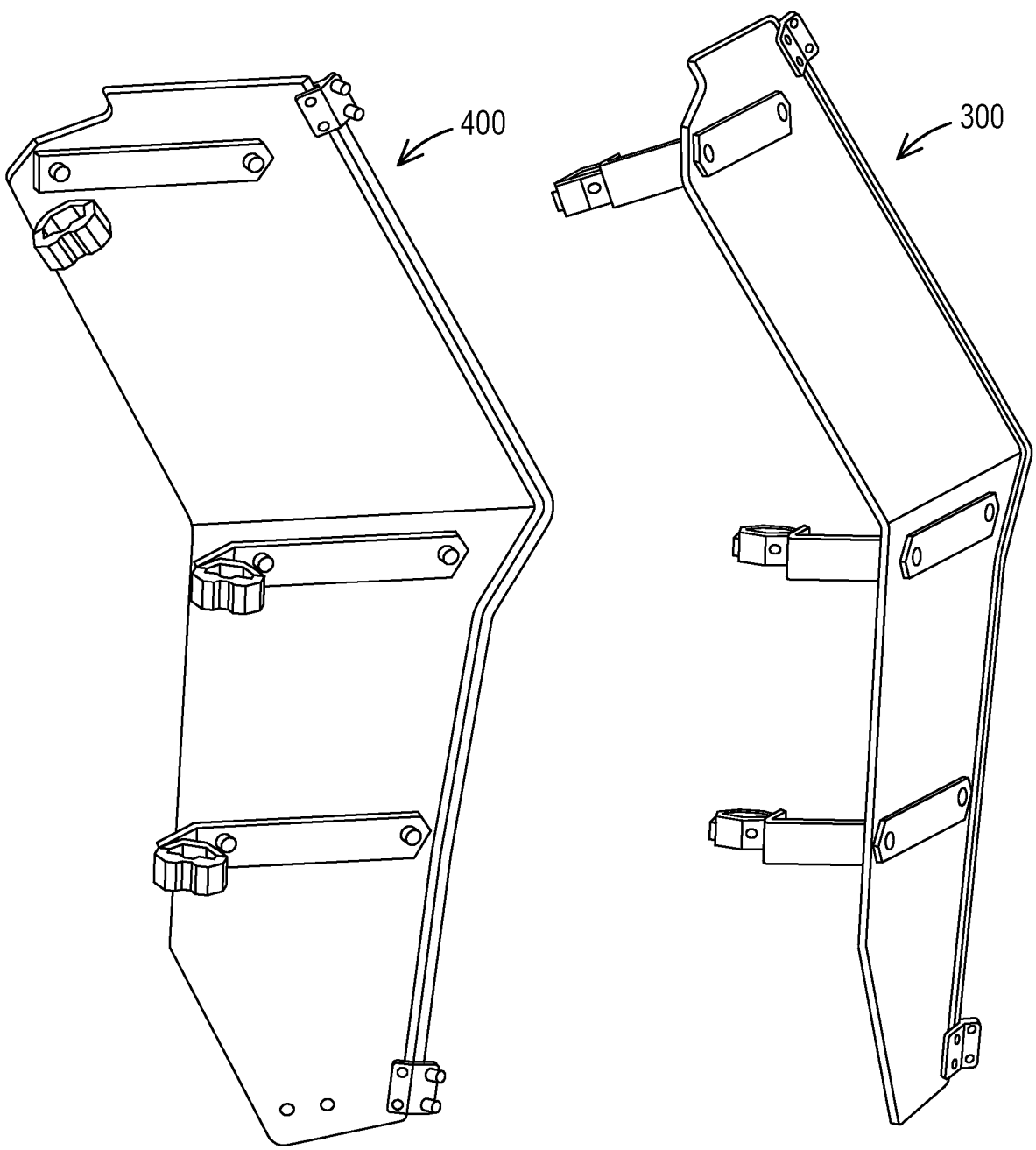
FIG. 5 shows an assembled fixed starboard side wind deflection apparatus and an assembled fixed port side wind deflection apparatus together as a set.

FIG. 5 shows an assembled fixed starboard side wind deflection apparatus 300 and an assembled fixed port side wind deflection apparatus 400 together as a set 500. The set 500 shows the relative positions of the fixed starboard side wind deflection apparatus 300 and an assembled fixed port side wind deflection apparatus 400 when secured to an example embodiment of a center console 206.

Figure 6:
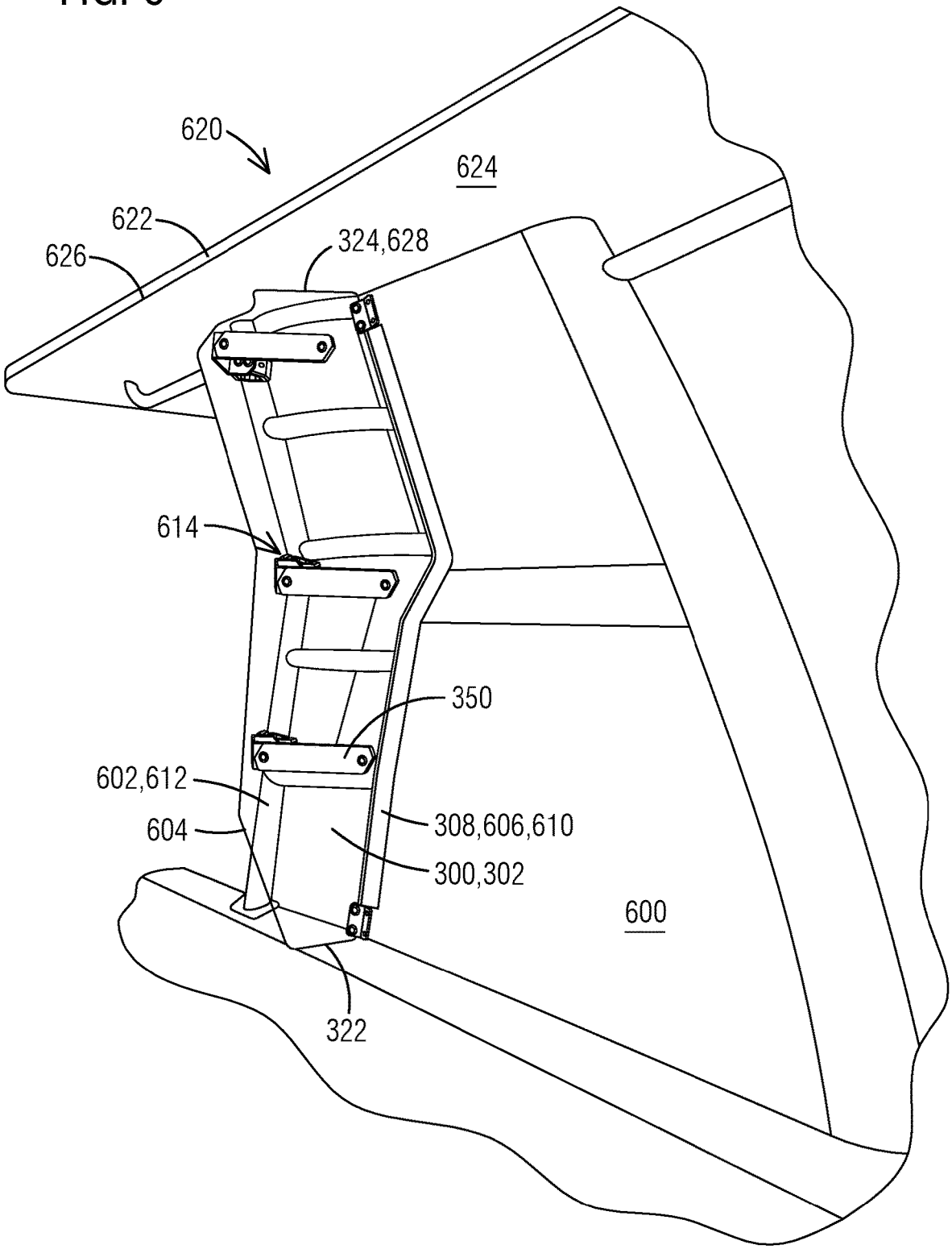
FIG. 6 shows the fixed starboard side wind deflection apparatus of FIG. 3 secured to an example center console.

FIG. 6 shows the fixed starboard side wind deflection apparatus 300 secured to an example center console 600. In this example embodiment, the center console 600 includes a post 602 at a downstream end 604 of the center console 600 to which the fixed starboard side wind deflection apparatus 300 is secured via the mounting apparatus 350. In this example embodiment, a leading edge profile/shape 606 of the leading edge 308 of the fairing 302 cooperates with (e.g. matches, follows) a side profile/shape of the center console 600. In an example embodiment, the leading edge 308 forms a seal 610 with the center console 600 in one or more locations along the leading edge 308.

The post 602 in this example embodiment defines a post profile/shape 612. The leading edge profile 606 of this example embodiment follows the post profile 612. For example, when moving upward from a bottom edge 322 of the fairing 302, the post profile 612 proceeds (moves forward toward the bow 130) along the bow-to-stern axis 120 until reaching an apex 614. Above the apex 614, the post profile 612 recedes (moves rearward toward the stern 132) along the bow-to-stern axis 120. The leading edge profile 606 likewise proceeds and then recedes, thereby matching the post profile 612. The resulting shape of the fairing 302 keeps the fairing 302 as far astern as possible, thereby reducing the magnitude of the starboard fairing angle 264 and the starboard fairing perceived width 270 necessary to create an appropriately placid slipstream 260. This, in turn, reduces an obtrusiveness (e.g. lateral obtrusiveness) of the fixed starboard side wind deflection apparatus 300.

In this example embodiment, the center console 600 includes a T-top 620 having a lip 622 and an underside 624. The top edge 324 of the fairing 302 cooperates with the underside 624. As used herein, cooperates with the underside 624 means that a shape of the top edge 324 matches a shape of the underside 624, the top edge 324 is closer to the underside 624 than a bottom edge 626 of the lip 622, and/or the top edge 324 forms a seal 628 with the underside 624.

Figure 7:
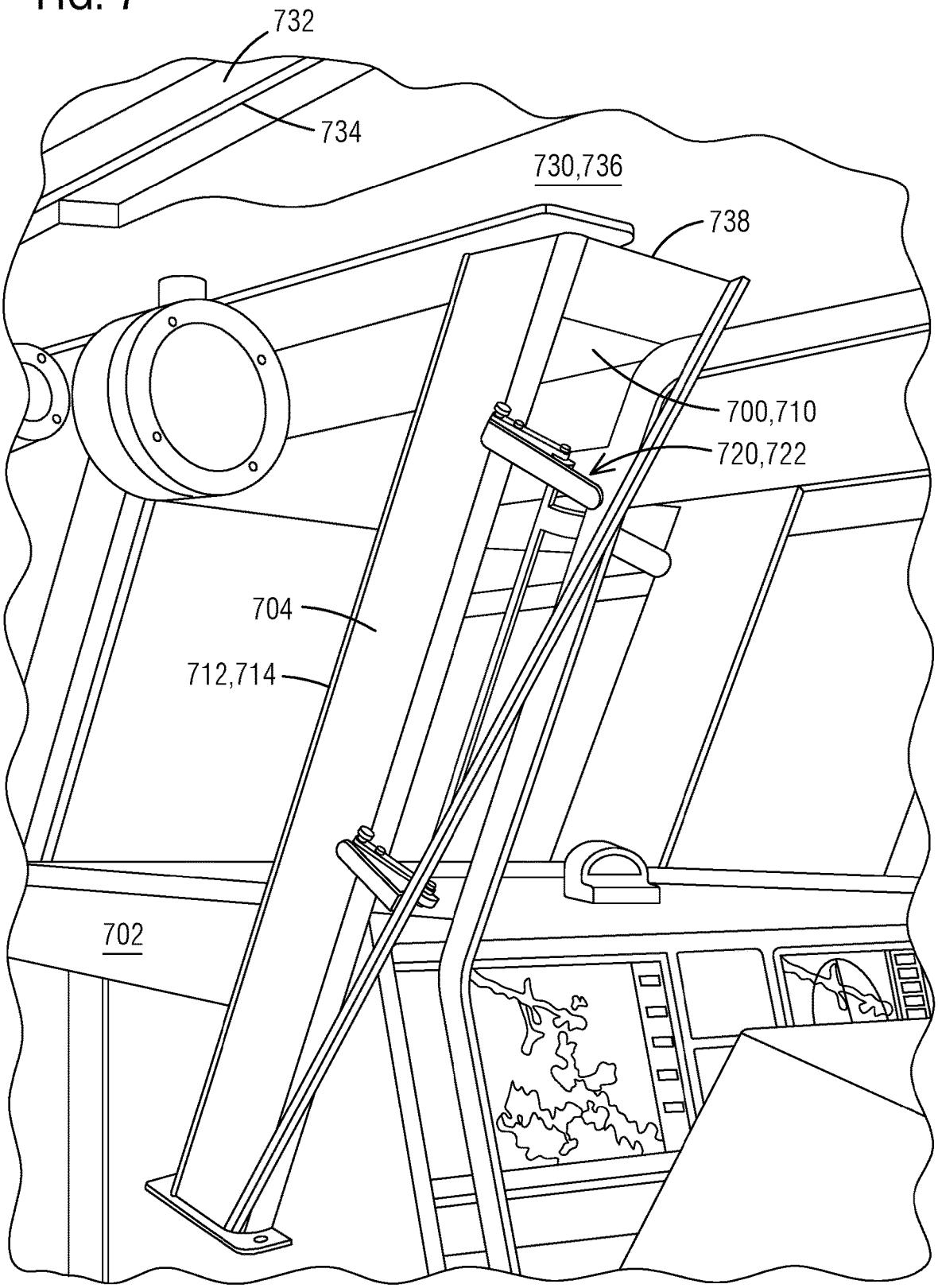
FIG. 7 shows an example embodiment of a pivoting port side wind deflection apparatus in a retracted position.

FIG. 7 shows an example embodiment of a pivoting port side wind deflection apparatus 700 in a retracted position in which the port fairing angle is relatively small. The center console 702 in this example embodiment includes a post 704 that is straight. The pivoting port side wind deflection apparatus 700 includes a fairing 710 and a pivot 712 at a leading edge 714 of the fairing 710. Because the post 704 is straight, the pivot 712 can be a hinge that extends along some or all of the leading edge 714. However, the pivot 712 need not be a hinge, but can instead be one or more pivot points distributed along the leading edge 714 and of a configuration known to the artisan. Such pivot points may be useful in instances where the post is not straight. In an example embodiment, the leading edge 714 forms a seal with the side of the center console 702, which includes the post 704.

The pivoting port side wind deflection apparatus 700 includes a mounting apparatus 720 that includes the pivot 712 and further includes a positioning assembly 722 secured to the fairing 710 and that can hold the fairing 710 in the retracted position shown, can hold the fairing 710 in an extended position, and can move the fairing 710 between the retracted position and the extended position. In this example embodiment, the center console 702 includes a T-top 730 having a lip 732 with a bottom edge 734, an underside 736, and a top edge 738 of the fairing 710 cooperates with the underside 736 when retracted and/or when extended. A pivoting starboard side wind deflection apparatus (not shown) may be secured to the starboard side of the center console 702 and may be a mirror image of the pivoting port side wind deflection apparatus 700 or may be modified to accommodate the shape/profile of the starboard side of the center console 702.

Figure 8:
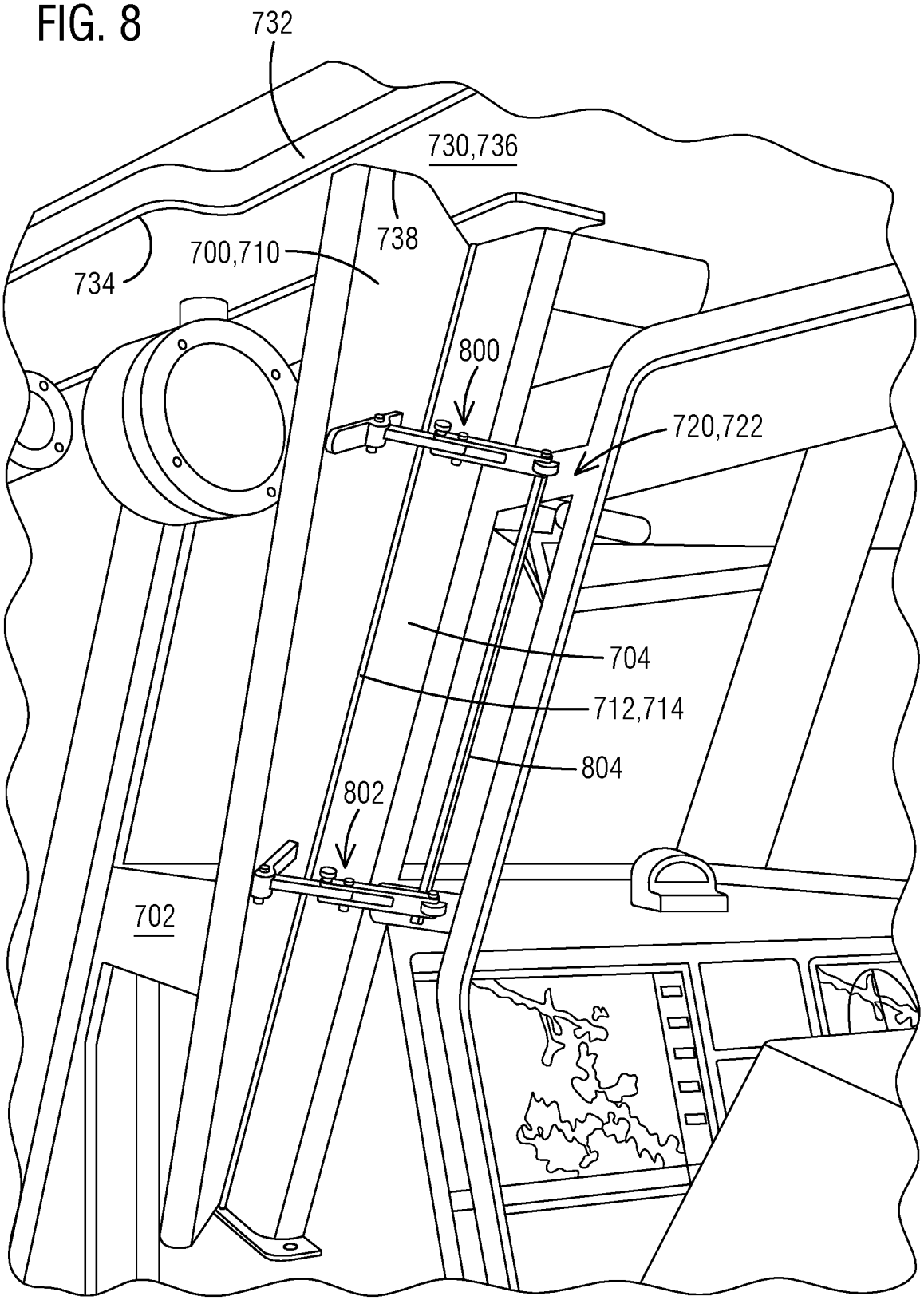
FIG. 8 shows the example embodiment of the pivoting port side wind deflection apparatus of FIG. 7 in an extended position.

FIG. 8 shows the example embodiment of the pivoting port side wind deflection apparatus 700 of FIG. 7 in an extended position in which the port fairing angle is relatively large. The pivoting port side wind deflection apparatus 700 is held in the extended position by the positioning assembly 722. In this example embodiment, the positioning assembly 722 includes a first positioning arm 800, a second positioning arm 802, and a lever arm 804 that coordinates the first positioning arm 800 and the second positioning arm 802. However, a single positioning arm would suffice.

Figure 9:
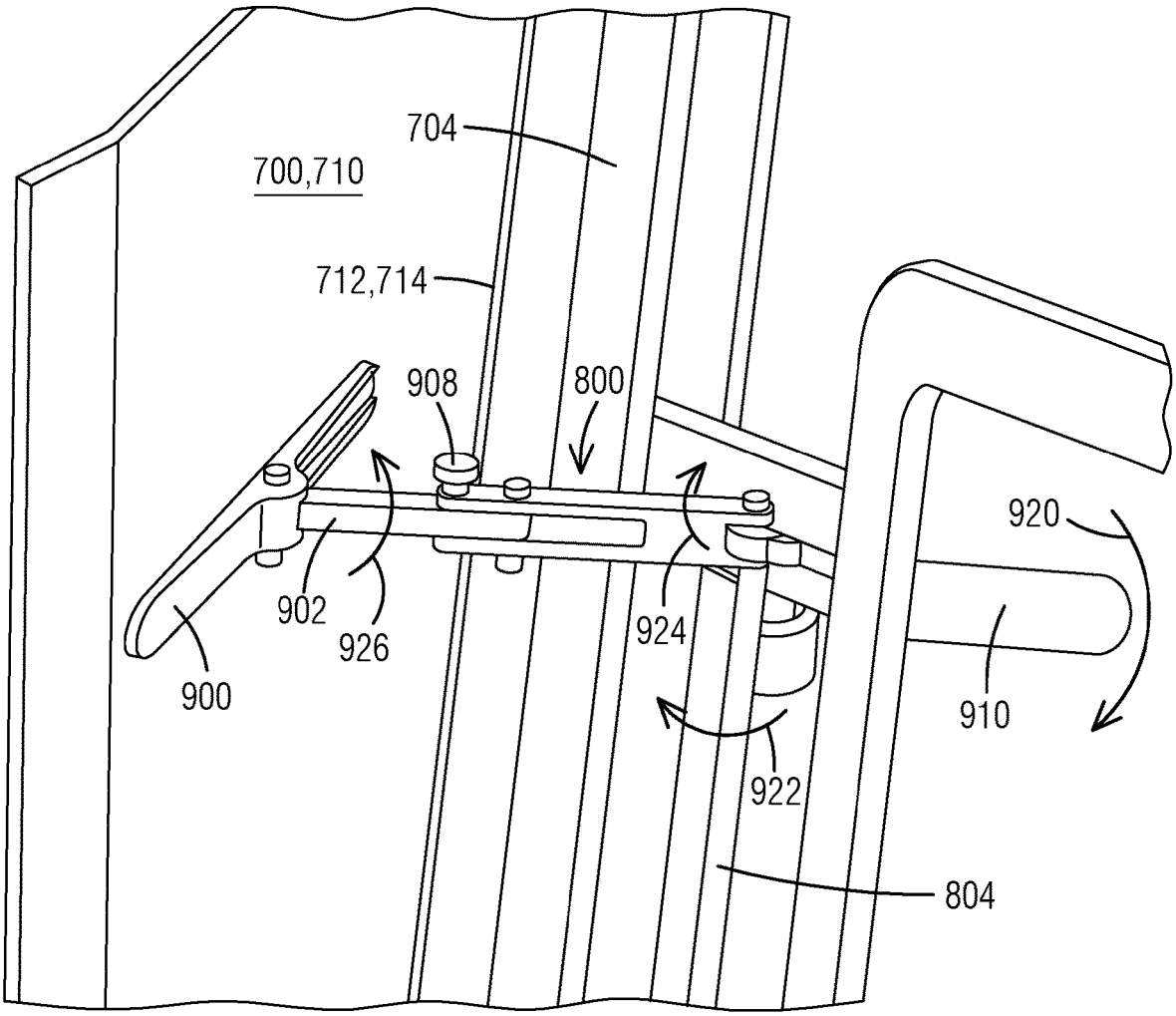
FIG. 9 shows an example embodiment of a positioning assembly of the port side wind deflection apparatus of FIG. 8.

FIG. 9 shows a closeup view of the first positioning arm 800 and a portion of the lever arm 804. The first positioning arm 800 and the second positioning arm 802 each include an arm brace 900 secured to the fairing 710, an intermediate linkage 902 pivotally secured to the arm brace 900 and also pivotally secured to an arm bracket 904. The arm bracket 904 is pivotally secured to the post 704 and fixedly secured to the lever arm 804. A handle is secured to the lever arm 906. A pin 908 in the arm bracket 904 locks into the intermediate linkage 902 to hold the pivoting port side wind deflection apparatus 700 in the extended position.

To retract the fairing 710 to the retracted position, the pin 908 is lifted and the handle 910 is moved as shown by arrow 920. This rotates the lever arm 804 as shown by arrow 922. This, in turn, rotates the rigidly attached arm bracket 904 as shown by arrow 924. The movement of the arm bracket 904 causes the intermediate linkage 902 to move as shown by arrow 926. These movements cause the arm bracket 904 and the intermediate linkage 902 to fold onto each other, which retracts the fairing 710. Since the lever arm 804 in this example embodiment is connected to both the first positioning arm 800 and the second positioning arm 802, the same movements occur in both positioning arms 800, 802. When the fairing 710 is in the retracted position, moving the lever arm 804 in the direction opposite of arrow 920 reverses this operation and moves the fairing 710 to the extended position, where the pin 908 can be installed in the intermediate linkage 902 to hold the fairing 710 in the extended position.

As disclosed above, the inventor has created a wind deflection apparatus that significantly increases a boating experience and yet is inexpensive, and simple to install and maintain. Accordingly, the wind deflection apparatus represents an improvement in the art.

While various embodiments of the present invention have been shown and described herein, it will be obvious that such embodiments are provided by way of example only. Numerous variations, swapping of features among embodiments, changes, and substitutions may be made without departing from the invention herein. Accordingly, it is intended that the invention be limited only by the spirit and scope of the appended claims.

The invention claimed is:

1. A wind deflection apparatus configured to be mounted to a watercraft, comprising:

a fairing shaped to comprise a leading edge profile that is configured to cooperate with a side profile of a console to redirect an oncoming airflow laterally away from an occupant positioned behind the console;

a mounting apparatus configured to secure the fairing relative to the console;

wherein the mounting apparatus comprises a bracket configured to secure the fairing to the console; and wherein the bracket comprises a post clamp configured to secure the fairing to a post of the console.

2. The wind deflection apparatus of claim 1, wherein the fairing comprises a transparent material.

3. The wind deflection apparatus of claim 1, wherein the fairing comprises a material comprising a tensile strength of at least 8000 psi (55.2 MPa) and a modulus of elasticity of at least 300000 psi (2,100 MPa) as determined by ASTM Method D638.

4. The wind deflection apparatus of claim 1, wherein the fairing comprises acrylic, glass, aluminum, carbon fiber, or fiber glass.

5. The wind deflection apparatus of claim 1, wherein the fairing comprises a first end, a second end, and a panel therebetween, wherein the panel comprises a width dimension that tapers from the first end to the second end.

6. The wind deflection apparatus of claim 1, further comprising a brace configured to secure the fairing to the bracket, wherein the brace clamps the fairing therein.

7. The wind deflection apparatus of claim 1, wherein the mounting apparatus is configured to support the fairing when redirecting the oncoming airflow flowing at up to 100 miles per hour.

8. A watercraft console comprising the post and the wind deflection apparatus of claim 1.

9. A watercraft comprising the watercraft console of claim 8.

10. The watercraft console of claim 8, wherein the post is disposed at a downstream end of the console relative to a bow-to-stern axis of the console; and wherein the mounting apparatus is configured to secure the fairing to the post.

11. The watercraft console of claim 8, wherein the post defines a post profile; wherein the mounting apparatus is configured to secure the fairing to the post; and wherein the leading edge profile also proceeds and recedes with the post profile along a bow-to-stern axis of the console.

12. The watercraft console of claim 8, further comprising a center console boat comprising the console.

13. A wind deflection apparatus, comprising:

at least one fairing configured to be secured proximate to a downstream end of a console relative to a bow-to-stern axis of the console;

wherein a shape of the fairing cooperates with a side profile of the console to redirect an oncoming airflow laterally away from an occupant positioned behind the console; and wherein the at least one fairing is configured to be secured to a post of the console.

14. The wind deflection apparatus of claim 13, where a shape of a top of the at least one fairing cooperates with a shape of an underside of a top of the console.

15. The wind deflection apparatus of claim 13, wherein fairing comprises a transparent material.

* * * * *